United States Patent [19]

Wingate

[11] 4,282,590

[45] Aug. 4, 1981

[54] ADJUSTABLE POSITION SONAR TRANSDUCER DEPTH FINDER

[76] Inventor: Kenneth G. Wingate, 1027 Algonquin Trail, Frankfort, Ky. 40601

[21] Appl. No.: 66,473

[22] Filed: Aug. 13, 1979

[51] Int. Cl.[3] ..... H04R 1/44

[52] U.S. Cl. ..... 367/104; 367/173

[58] Field of Search ..... 367/12, 104, 120, 165, 367/173

[56] References Cited

U.S. PATENT DOCUMENTS

| | | | |
|---|---|---|---|
| 2,837,727 | 6/1958 | Mayes | 367/173 |
| 3,752,431 | 8/1973 | McBride | 367/173 |

*Primary Examiner*—Richard A. Farley

*Attorney, Agent, or Firm*—Wm. R. Price

[57] ABSTRACT

An electronic depth finder apparatus is shown for use in fishing and/or navigation, and it includes a combined impulse control means and read-out, as well as a remote cooperating transducer immersed in the water. The invention relates to a means of adjustably mounting the transducer on a boat so that the transducer may be capable of as many as three planes of movement; namely, swinging movement in a vertical plane, unlimited rotational movement in a horizontal plane about a vertical axis, and up and down vertical movement between a lower "searching" position and an upper "running" position. The upper "running" position allows operation of the apparatus when the boat is moving at high speeds.

9 Claims, 8 Drawing Figures

ADJUSTABLE POSITION SONAR TRANSDUCER DEPTH FINDER

BACKGROUND OF THE INVENTION

1. Field of the Invention

This invention relates to the art of adjustable position electronic depth finders or SONAR depth sounders for use in water by pleasure boating enthusiasts and serious fishermen as a navigational aid and as a fish finder so as to overcome underwater blindness. This invention can be used as a tool to serve as eyes and ears under the water.

2. Description of the Prior Art

Electronic depth finders or SONAR transducer depth sounders have been known and used for many years. They are also called by various other names; such as depth flasher, fish locator, fish flasher, depth meter, depth recorder and scanning SONAR.

SONAR was introduced around the time of World War II. The word SONAR is an acronym for "sounding, navigation and ranging." A sound tone is created electronically and sent out into the water in a cone-like fashion. The speed of sound in water is about 4,950 feet per second. When that sound wave hits a solid object, part of the sound is reflected back to the source as an echo. By carefully timing how long it takes for the echo to return, it is possible to determine the distance between the object and the source.

The relatively low cost electronic depth finders that are widely used today by avid fishermen employ a main battery operated control box located in the boat and having an electronic device that creates an electrical impulse which travels from the main box through an electrical cable to a transducer device that is generally placed in the water. The transducer is a controlled sound wave energy transmitter and receiver that converts the electrical impulse into a high frequency sound impulse that is inaudible to the fish as well as to humans. The transducer may be aimed at the bottom of the body of water, or at a rock, at a sunken tree, or a school of fish. The echo bounces back to the transducer which reconverts that sound back into an electrical impulse which shows up on a dial that reads directly in feet or fathoms. The main box may include a volume sensitivity or gain control so that the sound signal may be adjusted loud enough to bounce back an echo if the water is very deep or the body of water has a soft mud bottom which tends to absorb the sound.

There are five main types of control box and readouts for electronic depth sounders: (1) the flasher unit is the most popular type of sounder and it employs a motor driven wheel which supports a flashing neon bulb or light emitting diode which flashes about 24 impulses per second, and displays the bottom depth in terms of a band of light on a calibrated dial, (2) the meter unit employs a needle in combination with a dial, (3) the recorder or graph unit interprets the signal for the operator and actually draws or prints out a permanent picture of the bottom showing the slopes and drop-offs, boulders, trees and fish, (4) combination flasher-recorder units provide the speed reading of the flasher unit and the means of obtaining a detailed graph of an unusual formation, (5) the scanning SONAR unit is for commercial fishermen and charter boats and it scans a 360° circle and the conditions may be read on a graph or recording type instrument or on a direct read-out on the face of a cathode ray tube, which is the same as a TV picture tube.

The Lowrance Electronics Mfg. Corp. of Tulsa, Okla. probably introduced the first electronic depth finder for consumer use; known as the FISH LO-K-TOR.

In the past, the transducers were either fixedly mounted to the stern of the boat beneath the water line, or mounted at the bottom of a vertical shaft that has a mounting bracket fastened to the transom or gunwale of the boat. This vertical shaft is rotatable about a vertical axis for 360° scanning horizontally.

The Mayes U.S. Pat. No. 2,837,727 discloses a general type of adjustable position vertical shaft for mounting a hydrophone below water.

Another front-end mounting location for the transducer has been to the keel of an electric trolling motor at about a 45° angle to the vertical axis of the supporting shaft of the motor so the transducer may be rotated through an angle of 360°.

OBJECTS OF THE PRESENT INVENTION

The principal object of the present invention is to provide an adjustable mounting means for the transducer of an electronic depth finder apparatus so the transducer may have as many as three planes of movement, either in unison or in combination; namely, swinging movement in a vertical plane, unlimited rotational movement in a horizontal plane about a vertical axis, and up and down vertical movement between a lower "searching" position and an upper "running" position.

A further object of the present invention is to provide an adjustable mounting means of the class described using a large threaded shaft as the main element having a top operating lever and a cooperating bottom controlled lever or support lever on which the transducer is mounted.

A further object of the present invention is to provide an adjustable mounting means of the class described with a motion transmitting means joining the two top and bottom levers, in the form of a rack and pinion mechanism.

A further object of the present invention is to provide an adjustable mounting means of the class described with an electrical cable feeding down through the shaft and electrically connected between the transducer and a combined impulse control means and read-out positioned on the boat.

A further object of the present invention is to provide an adjustable mounting means of the class described wherein the threaded shaft is mounted through an oil filled cylinder bearing so that the shaft is self-lubricated.

A still further object of the present invention is to provide an adjustable mounting means of the class described wherein the rack and pinion mechanism is immersed in a bath of oil within the shaft so that the mechanism is self-lubricated.

SUMMARY OF THE INVENTION

The present invention provides an adjustable mounting means for the transducer of an electronic depth finder apparatus having a vertical shaft movably supported from a fixed mounting means. The shaft has a top operating lever and a cooperating bottom controlled lever or support lever on which the transducer is mounted. A motion transmitting means joins the two top and bottom levers so the levers act in motion whereby the transducer may be capable of at least two out of a possible three planes of movement; namely, swinging movement in a vertical plane, unlimited rotational movement in a horizontal plane about a vertical axis, and up and down vertical movement between a lower "searching" position and an upper "running" position.

BRIEF DESCRIPTION OF THE DRAWINGS

This invention will be better understood from the following description taken in conjunction with the accompanying drawings and its scope will be pointed out in the appended claims.

DESCRIPTION OF THE PREFERRED EMBODIMENTS

Figure 1:
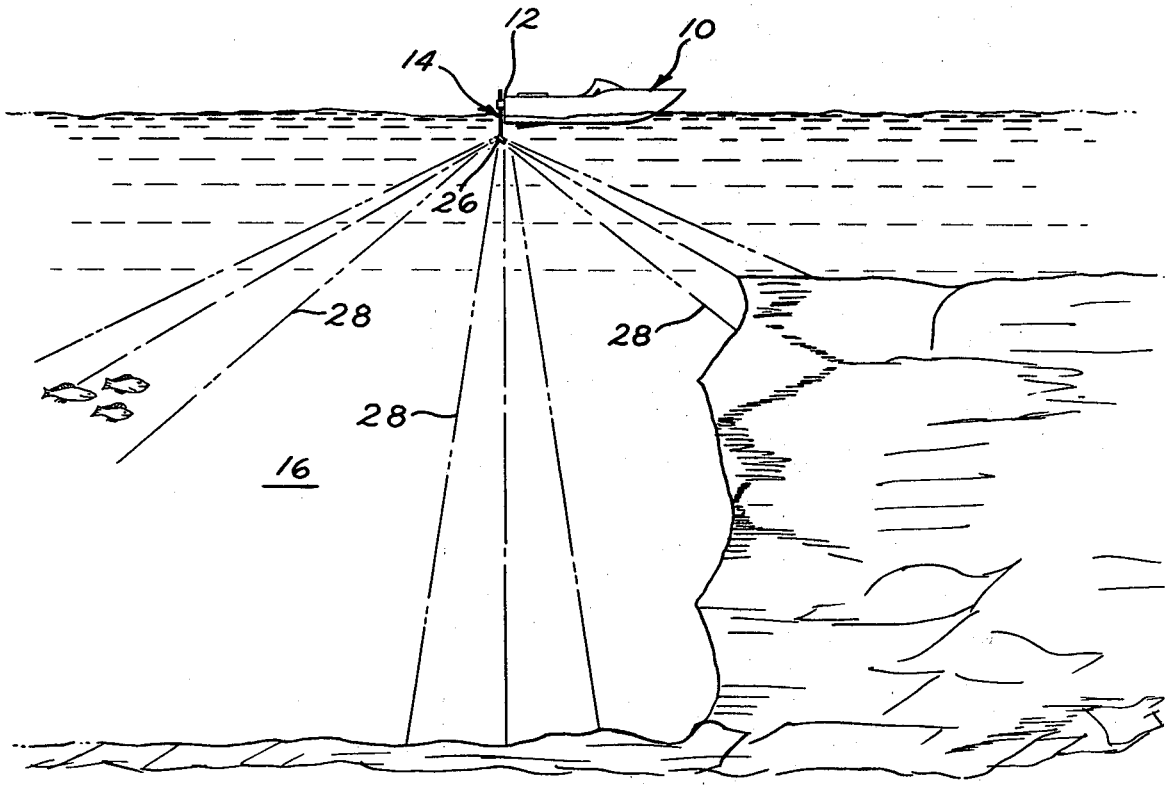
FIG. 1 is a panoramic and underwater view of a body of water showing a small power boat having mounted on its stern an electronic depth finder apparatus according to the present invention where the transducer of the apparatus may be adjusted at wide angles to detect from a single location or position underwater formation or structures, the depth of the bottom of the water, as well as the presence or movement of fish.

Turning now to a consideration of the drawings and, in particular, to the panoramic and underwater view of FIG. 1 there is shown a small motorboat 10 having mounted on its stern 12 the electronic depth finder apparatus 14 of the present invention, shown in its "searching" position. The apparatus can only be operated by a person positioned near the stern of the boat. The body of water 16 is shown with three prominent areas of interest; a school of fish, the bottom of the body of water, and a shallow ledge or drop-off.

The bottom portion of the apparatus 14 includes a transducer 26 which has sound waves which descend in cone-like fashion as seen at 28, much like the light rays of a search light (not shown).

Figure 2:
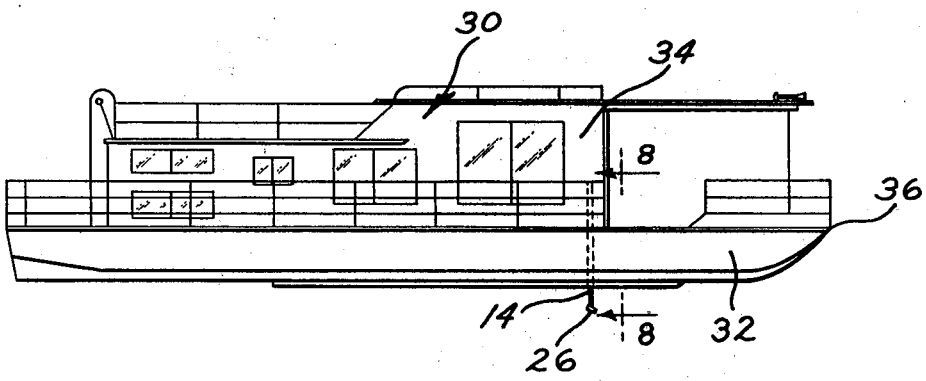
FIG. 2 is a side elevational view of a houseboat showing the adjustably mounted, electronic depth finder of the apparatus of the present invention, installed up through the hull of the boat so that the operating lever and control box will be conveniently located within the bridge of the houseboat.

FIG. 2 shows a large houseboat 30 having the electronic depth finder apparatus 14 of the present invention mounted amidship up through the hull 32 of the boat so that the Captain of the boat can operate the apparatus from the bridge 34 of the boat, near the bow 36 thereof.

Figure 3:
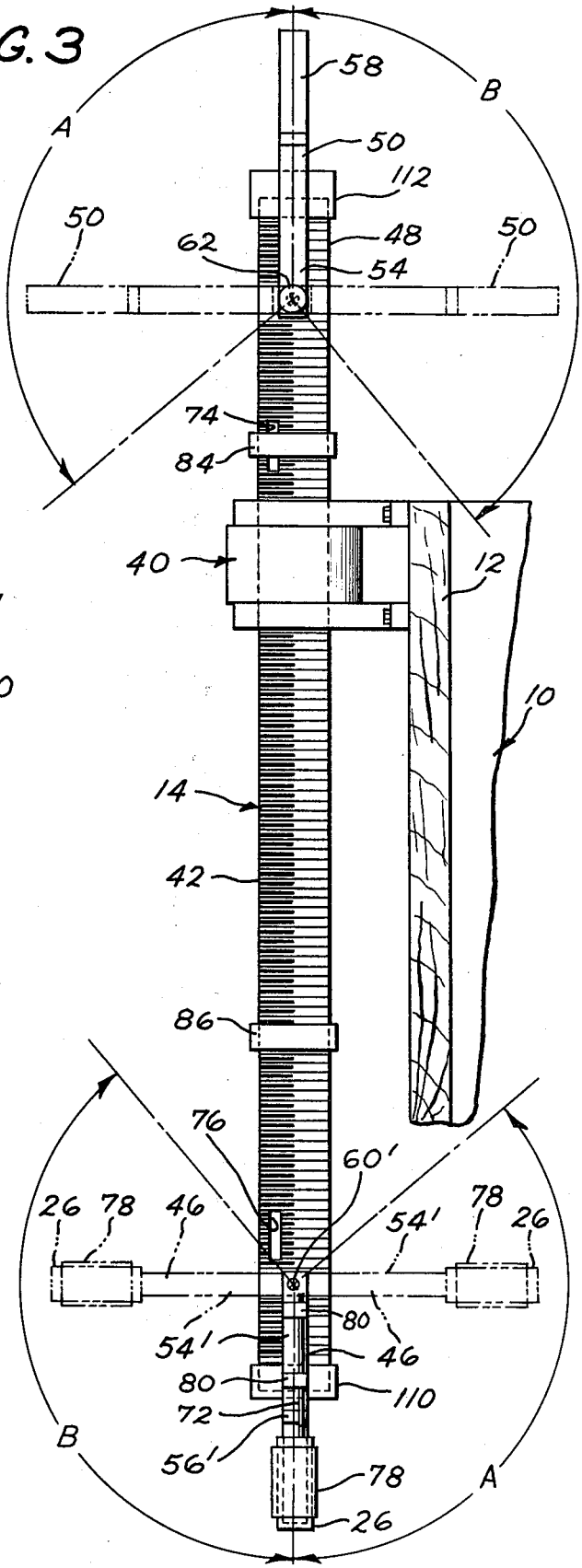
FIG. 3 is a fragmentary, partial, cross-sectional side elevational view on a much larger scale of the stern of a small motorboat showing the electronic depth finder apparatus of the present invention adjustably mounted to the stern for movement in at least three planes, with the transducer in its "searching" position.
Figure 7:
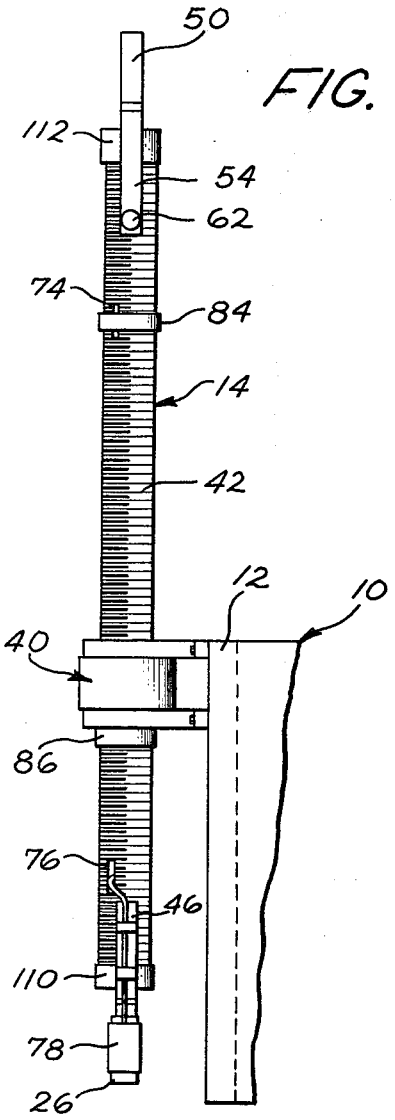
FIG. 7 is a fragmentary, side elevational view similar to that of FIG. 3, but on a reduced scale, showing the threaded shaft raised to its topmost "running" position, where the transducer is positioned above the bottom of the boat hull.

FIG. 3 shows a fragmentary, partial, cross-sectional side elevational view at the stern 12 of the motorboat 10. The electronic depth finder apparatus 14 has a fixed mounting means 40 for attaching the apparatus to the stern 12 of the motorboat. This is a protective position for the transducer 26 because the apparatus may be lowered into its "searching" position, as is shown in FIG. 3, or it may be raised into its "running" position, above the bottom of the hull, as is shown in FIG. 7, so as to be protected from hitting obstructions such as floating logs, debris, underwater structures, etc.

The main element of the depth finder apparatus 14 is a large vertical, externally threaded shaft 42 which is adjustably mounted to the fixed mounting means 40 both vertically and rotationally by turning the shaft relative to the mounting means, as will be explained later with reference to FIG. 5.

At the bottom portion of the shaft, a first movable controlled lever or support lever 46 is pivotally mounted to the shaft and is capable of movement in a vertical plane through a wide angle that approaches about 270°.

At the top portion 48 of the shaft, a second movable operating lever 50 is pivotally mounted to the shaft, and it is likewise capable of movement in a vertical plane through a wide angle that approaches about 270°.

A motion transmitting means is provided within the shaft 42 to couple between the top operating lever 50 and the bottom controlled lever or support lever 46, as will be explained later in detail with reference to FIG. 5. Hence, a given movement of the top lever will cause a predetermined like-movement of the bottom lever. It is this bottom lever 46 to which the transducer 26 is attached.

Figure 4:
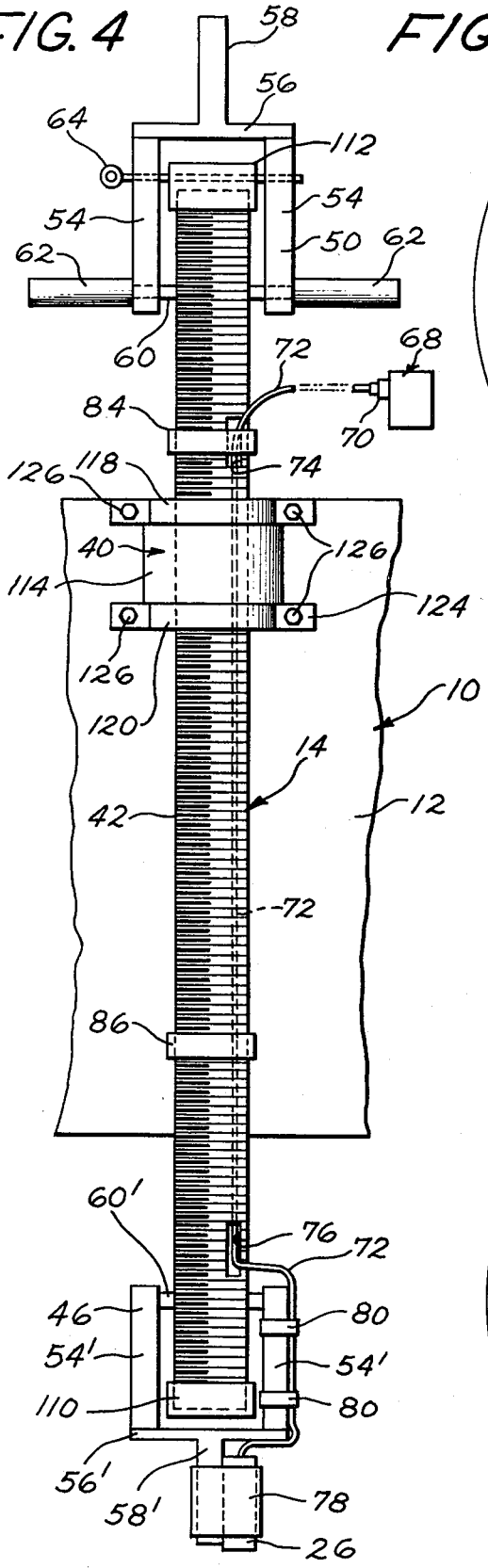
FIG. 4 is a fragmentary rear elevational view of the boat of FIG. 3 showing more of the details of the electronic depth finder apparatus of the present invention.

As is best seen in the rear elevational view of FIG. 4, each lever 46 and 50 is formed as a U-shaped bracket member with parallel side arms 54 and a cross piece 56. The cross piece 56 of the top operating lever or bracket 50 has a handle extension 58 for ease in changing the position of or aiming the lever during use. A through-bolt 60 extends through suitable holes near the free ends of the side arms 54 of the bracket and completely through the top portion 48 of the shaft 42 to serve as a pivot means of the bracket. The location of this through-bolt is such that the U-shaped bracket is capable of swinging free over the top end of the shaft for movement between the opposite sides of the shaft. In addition, the through-bolt 60 is provided with opposite end extensions 62 that serve as periscopic handles for ease in rotating the shaft 42 about its vertical longitudinal axis. The lower controlled lever or support bracket 46 may be formed the same as the top U-shaped bracket except with parts 54', 54', 56', 58', and 60'.

A transverse locking pin 64 is shown in FIG. 4 extending through suitable aligned holes in the side arms 54, 54 and the shaft 42 so as to lock the operating lever 50 and hence the controlled lever 46 in their vertical positions, as is shown in full lines in both FIGS. 3 and 4.

Looking at FIG. 4, a box 68, of the electronic depth finder apparatus 14, is shown for placement in the boat, and it represents a combined impulse control means and read-out. This box has a plug-in connection means 70 at the back for receiving a connector of an electrical cable 72 therein. This cable is fed into a side access opening 74 in the side of the shaft, near the top thereof and then down through a hollow portion of the shaft, and then out of another side access opening 76 near the bottom of the shaft. Then the cable 72 is loosely looped to the side arm 54' of the lower controlled lever 46, and then joined as an integral part of the transducer 26. A heavy duty elastic band 78 serves to strap the transducer 26 to the handle extension 58' of the U-shaped lever or bracket 46. Adhesive tape 80 may be used to secure the cable 72 snag-free to the side arm 54'.

A pair of vertically spaced stop rings 84 and 86 are threaded onto the shaft 42 to serve as vertical movement limit means when the shaft 42 is rotated about the fixed mounting means 40. Notice in FIG. 7 that the lower stop ring 86 has engaged the fixed mounting 40 so that the shaft 42 may not rise any higher. Also notice that the transducer 26 is in its raised or "running" position above the bottom of the boat's hull so as to be protected from damage by underwater obstacles during running of the boat.

Figure 5:
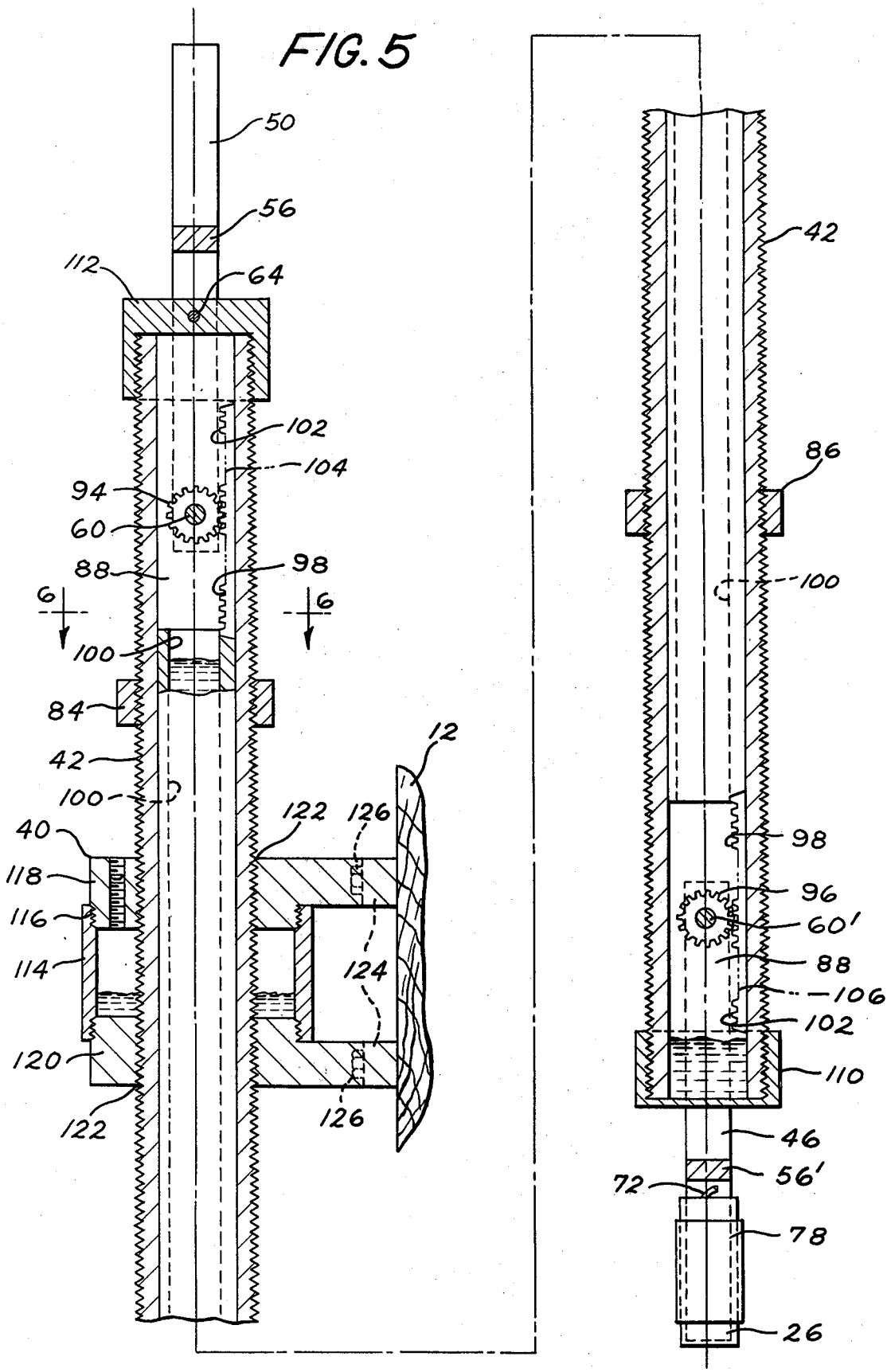
FIG. 5 is a two-part fragmentary cross-sectional elevational view on an enlarged scale of the threaded shaft shown supported in a hydraulic cylinder bearing that serves as the fixed mounting means of the apparatus of the present invention. This view is shown in two parts that are arranged side-by-side. The top half is shown on the left side, and the bottom half is shown on the right side. A principal feature of this view is the rack and pinion mechanism that serves as the motion transmitting means between the top operating lever and the bottom controlled lever or support lever on which the transducer is mounted.

Now turning to a consideration of the two-part fragmentary cross-sectional elevational view of FIG. 5 of the externally threaded vertical shaft 42, the view has been made in two parts because the shaft is so long in its vertical dimension. The shaft has two hollow channels which are formed therethrough, as is best seen in the transverse cross-sectional view of FIG. 6. There is a central rectangular shaped channel 88, and an offset circular channel 90 for receiving the electrical cable 72 therethrough. It should be understood that the two side access openings 74 and 76 for the cable 72 communicate with this offset circular channel 90. Elongated LEXAN plugs (not shown) may be inserted in the portion of the channel 90 above the topmost side access opening 74, as well as in the portion of the channel 90 below the bottommost side access opening 76 so as to seal off these unused end portions of the channel 90. Rubber plugs act as a seal for cable 72.

Figure 6:
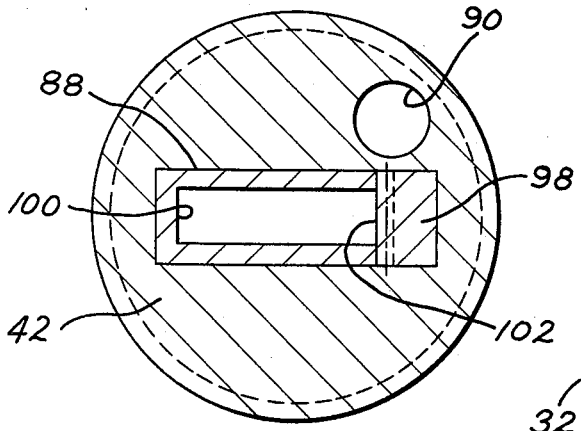
FIG. 6 is a transverse cross-sectional plan view of the threaded shaft taken on the line 6—6 of FIG. 5.

Positioned within the rectangular shaped channel 88 is a motion transmitting means which joins the top operating lever 50 with the bottom controlled lever 46. This motion transmitting means includes a rack and pinion mechanism that includes a pair of pinion gears 94 and 96 that are joined by a common rack member 98 that meshes therewith. The top pinion 94 threads onto the center of the through-bolt 60 of the top operating lever or bracket 50, while the bottom pinion 96 threads onto the center of the through-bolt 60' of the bottom controlled lever or bracket 46. The rack member 98 need not have teeth for its entire length because of the limited reciprocating movement of the rack member between its extreme top and bottom positions. Hence the midportion 100 of the rack member 98 is of hollow rectangular shape, as is best seen in FIGS. 5 and 6. The rack member 98 has a plurality of rack teeth 102 at the opposite ends 104 and 106.

As the top operating lever or bracket 50 is moved, the top pinion gear 94 is turned which causes the travel of the rack member 98, since the pinion engages with the teeth 102 of the upper rack section 104. Any vertical movement of the rack member 98 causes the turning action of the bottom pinion gear 96 because the teeth 102 of the lower rack section 106 mesh with the teeth of the pinion 96. The bottom of the hollow shaft 42 is sealed by a screw-on end cap 110, while the top of the shaft is likewise sealed by a similar screw-on end cap 112. A transmission oil is provided in this sealed hollow shaft to serve as a self-lubricating means for the rack and pinion mechanism 94, 96 and 98. The hollow midportion 100 of the rack member allows the oil to flow freely within the hollow shaft as the rack member rises and falls, so that the oil does not become compressed as in a piston and cylinder environment.

Now turning to a consideration of the fixed mounting means 40 as is shown in FIG. 5, there is a cylinder or pipe section 114 having internal threads 116 at the top and bottom ends. There are two similar parts, a top 118 and a bottom 120 anchoring and rotation collars joined to the cylinder 114 to form a sealed cylinder or bearing. Each top and bottom collar 118 and 120 has an internally threaded opening 122 that are aligned with each other to receive the externally threaded shaft 42 downwardly therethrough. Each top 118 and bottom 120 anchoring and rotation collar has mounting flanges 124 with suitable openings for receiving mounting bolts 126 therethrough for fastening this entire assembly 14 to the stern 12 of the boat 10. This sealed cylinder 114 is likewise supplied with oil so that the external threads of the shaft 42 are self-lubricating.

In FIG. 1 the present invention is shown mounted on the stern of a small motorboat, while in FIG. 2 this invention is applied to a houseboat 30 through the hull 32.

Figure 8:
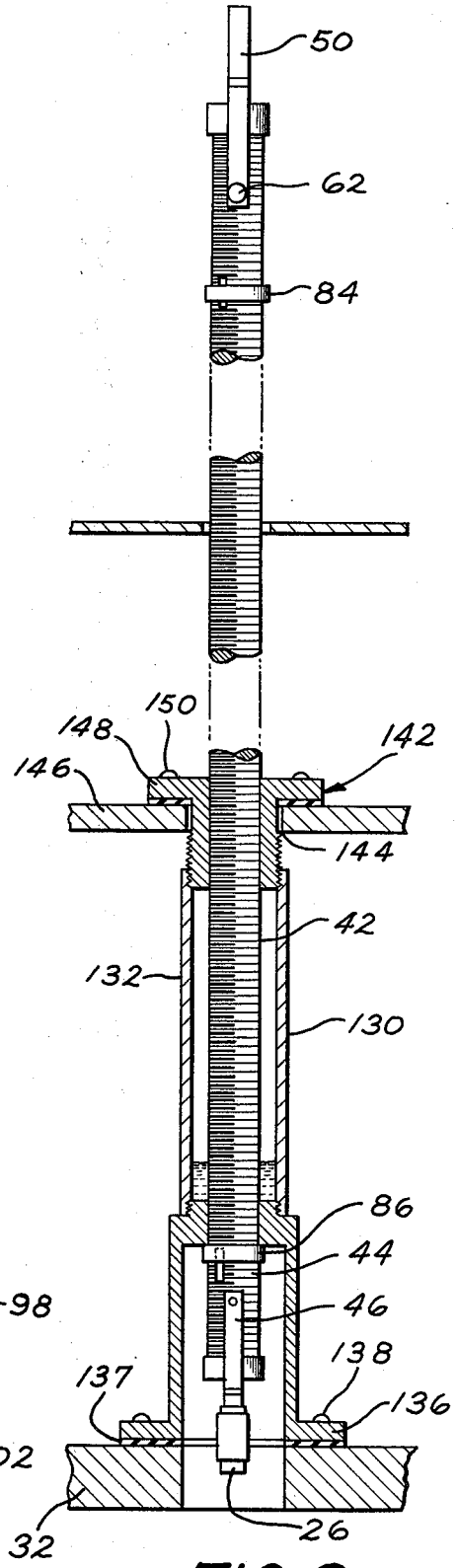
FIG. 8 is a fragmentary cross-sectional elevational view taken through the hull of a houseboat on a line 8—8 of FIG. 2, showing a permanent, recessed, mounting means that could be installed by the boat builder at the time of manufacture.

FIG. 8 is a more detailed showing of the mounting means of the present invention in the hull 32 of a large boat, such as a houseboat. Element 130 is a fixed mounting means comprising a cylinder or pipe section 132 that is internally threaded at each end. Sealed to the bottom is an enlongated bottom anchoring and rotation collar which screws into the lower end of the cylinder 132 and has a lower mounting flange 136 and rubber sealing gasket 137 with suitable openings for receiving mounting bolts 138 therethrough. This bottom collar member being elongated forms a recessed housing for receiving the lower end 44 of the threaded shaft 42 therein, including the lower controlled lever 46 and the transducer 26. The hull 32 has an opening for allowing the shaft 42 and transducer 26 to be lowered into its "searching" position, at will.

At the upper end of the cylinder 132 is a top anchoring and rotation collar 142 that is screwed into place. This top collar slips through a hole 144 in a deck 146, and is provided with a mounting flange 148 with mounting bolts 150. This cylinder 132 is likewise supplied with oil so the shaft 42 will continue to be self-lubricating.

As to the materials for use in manufacturing the present invention, plastic, rubber and stainless steel materials are preferred because of the rust and corrosion problems created by the immersion in water. The following parts may be molded of plastic such as Lexan ® resin or the like: threaded shaft 42, cylinder section 114, collars 118, 120, rack member 98, pinions 94 and 96, levers 46 and 50, top and bottom caps 112 and 110, and top and bottom stop rings 84 and 86, and bolts 60 & 60'.

The following hardware parts may be of stainless steel or the like: mounting bolts 126 and 150, locking pin 64.

Modifications of this invention will occur to those skilled in this art. Therefore, it is to be understood that this invention is not limited to the particular embodiments disclosed, but that it is intended to cover all modifications which are within the true spirit and scope of this invention as claimed.

What is claimed is:

1. An electronic depth finder apparatus for use in a fluid medium including a combined impulse control means and read-out as well as a remote cooperating transducer that is joined by connecting means therebetween, said apparatus comprising:

a. fixed mounting means for assembling the apparatus to a supporting structure;

b. a vertical shaft adjustably mounted to the said fixed mounting means both vertically and rotationally;

c. a first movable support lever pivoted to the bottom portion of the said shaft and capable of movement in a vertical plane through a wide angle, whereby a transducer may be mounted solely to this first support lever for transmitting and receiving controlled sound wave energy at a variety of directional angles with respect to the shaft as well as at a variety of vertical elevations relative to the said fixed mounting means;

d. a second movable operating lever pivoted to the top portion of the said shaft and capable of movement in a vertical plane through a wide angle;

e. the said shaft including motion transmitting means internally of the shaft for joining the top and bottom levers so that the two levers generally move in unison;

f. whereby the transducer is capable of at least two out of a possible three planes of movement; first, angular movement in a vertical plane along with the movement of the bottom support lever relative to the shaft; second, unlimited rotational movement in a horizontal plane about the longitudinal axis of the shaft as the shaft is turned; and third, vertical elevational movement due to the vertical movement of the shaft relative to the said fixed mounting means.

2. The invention of claim 1 wherein the said vertical shaft is of high impact resistant plastic material includes external threads which cooperate with internal thread means in the said fixed mounting means for accommodating both the vertical and the rotational adjustability of the shaft relative to this mounting means.

3. The invention of claims 1 or 2 wherein the said connecting means, between the combined impulse control means and read-out and the transducer that is mounted to the said first controlled lever at the bottom portion of the shaft, is an electrical cable that is fed down through the interior of the said shaft for a large portion thereof so as to be independent of the said fixed mounting means.

4. The invention of claims 1 or 2 wherein the said motion transmitting means internally of the shaft for acting between the top and bottom movable levers comprises a rack and pinion mechanism that is positioned within the shaft, whereby a separate pinion is joined to each lever and moves therewith, while a longitudinal rack member is mounted between the two pinions and engaged thereby, whereby a movement of the top operating lever will cause a similar movement of the bottom controlled lever, and a supply of oil sealed within the shaft for lubricating the said rack and pinion mechanism.

5. The invention of claim 1 wherein both the operating lever and the controlled lever are formed as U-shaped bracket members that are each supported from a through-bolt that extends transversely through the said shaft near the respective end thereof so that the bracket members may swing over the ends of the shaft and encompass a wide angle.

6. The invention of claim 5 wherein the said motion transmitting means acting between the top and bottom bracket members comprises a rack and pinion mechanism that is positioned within the shaft, where a pinion is fixed to each through-bolt of each bracket member and a longitudinal rack member engages both pinions, whereby a turning motion applied to the top operating bracket member will cause a comparable motion of the bottom controlled bracket member.

7. The invention of claim 5 wherein each U-shaped bracket member is provided with a handle extension, and means for joining the said transducer to the handle extension of the bottom bracket member.

8. The invention of claims 5, 6 or 7 wherein the throughbolt of the top operating bracket member has opposite side extensions to serve as periscopic handles for rotating the said vertical shaft.

9. The invention of claim 1 wherein the said vertical shaft includes external threads, and the said fixed mounting means comprises a cylinder having both a top and a bottom cap, each cap having an internally threaded opening for receiving the threaded portion of the shaft down therethrough, and a supply of oil sealed within the cylinder for lubricating the threads of the shaft, and vertically spaced top and bottom stop means fitted onto the shaft for engaging the cylinder when the shaft is turned within the cylinder for raising and lowering the shaft so as to serve as vertical movement limit means.

* * * * *